US010584936B2

(12) United States Patent
Hotz et al.

(10) Patent No.: US 10,584,936 B2
(45) Date of Patent: Mar. 10, 2020

(54) DUAL-MODE WEAPON TURRET WITH SUPPRESSIVE FIRE CAPABILITY AND METHOD OF OPERATING SAME

(71) Applicant: Control Solutions LLC, Aurora, IL (US)

(72) Inventors: Jeffery A. Hotz, Naperville, IL (US); Joseph Ergun, Wood Dale, IL (US); Raoul Castro, Gilberts, IL (US); Robert B. Stratton, Andover, MN (US); Bruce E. Florack, Rochester, NY (US); Nicholas J. Scholtes, Shorewood, IL (US)

(73) Assignee: Control Solutions LLC, Aurora, IL (US)

( * ) Notice: Subject to any disclaimer, the term of this patent is extended or adjusted under 35 U.S.C. 154(b) by 0 days.

(21) Appl. No.: 16/033,876

(22) Filed: Jul. 12, 2018

(65) Prior Publication Data

US 2020/0018565 A1 Jan. 16, 2020

(51) Int. Cl.
*F41A 27/20* (2006.01)
*F41A 27/30* (2006.01)

(52) U.S. Cl.
CPC ..... *F41A 27/20* (2013.01); *F41A 27/30* (2013.01)

(58) Field of Classification Search
CPC ..... F41A 27/20; F41A 27/28; F41A 27/30; F41A 27/24
See application file for complete search history.

(56) References Cited

U.S. PATENT DOCUMENTS 4,579,036 A * 4/1986 LeBlanc ..... F41A 27/20 74/625
7,245,251 B2 * 7/2007 Vogel ..... F41A 27/28 342/61
7,694,588 B2 * 4/2010 Stehlin ..... F41A 27/30 73/862.322
8,322,269 B2 * 12/2012 Sullivan ..... F41A 27/14 89/41.11
8,434,397 B1 * 5/2013 Deckard ..... B64D 7/06 89/37.13
8,443,710 B2 * 5/2013 Domholt ..... F41A 27/20 89/41.02
8,607,686 B2 * 12/2013 McKee ..... F41A 27/20 89/41.01
8,640,597 B2 * 2/2014 Hayden ..... F41A 27/28 89/37.03

(Continued)

*Primary Examiner* — Joshua T Semick
(74) *Attorney, Agent, or Firm* — McCracken & Gillen LLC

(57) ABSTRACT

A dual-mode turret system includes a turret base operable by a motor drive of the turret system, a cylindrical sleeve secured to the turret base, a mounting cylinder disposed in the cylindrical sleeve, and a frame secured to the mounting cylinder, wherein the frame is adapted to hold a weapon. The dual-mode turret system also includes a locking apparatus that when engaged prevents the mounting cylinder from rotating independently of the cylindrical sleeve, a controller, and an input device coupled to the controller. Rotation of the frame is manually adjustable when the locking apparatus is disengaged, and the rotation of the frame is adjusted by the controller in response to commands received from the input device when the locking apparatus is engaged.

19 Claims, 10 Drawing Sheets

(56) References Cited

U.S. PATENT DOCUMENTS

| | | | | |
|---|---|---|---|---|
| 8,894,024 | B2 * | 11/2014 | Deros | F16M 11/041 248/124.1 |
| 9,080,826 | B2 * | 7/2015 | Grelat | F41A 27/06 |
| 9,243,869 | B1 * | 1/2016 | Horvath | F41A 23/24 |
| 9,568,267 | B2 * | 2/2017 | Lung | F41A 9/79 |
| 9,644,916 | B2 * | 5/2017 | Hobson | F41A 23/24 |
| 10,054,400 | B2 * | 8/2018 | Szlemko | F41G 5/16 |
| 10,066,893 | B2 * | 9/2018 | Bei | F41B 7/08 |
| 2015/0267989 | A1 * | 9/2015 | Hobson | F41A 23/24 89/37.12 |

* cited by examiner

DUAL-MODE WEAPON TURRET WITH SUPPRESSIVE FIRE CAPABILITY AND METHOD OF OPERATING SAME

BACKGROUND

1. Field of the Disclosure

The present application is directed to a weapon turret system, in particular a dual-mode weapon turret system that an operator may use manually or remotely.

2. Description of the Background of the Disclosure

A weapon turret system includes a turret that is disposed on a vehicle, and a weapon such as a gun that may be disposed on the turret. Some turret systems are manually operated in which the operator manually moves the gun on the turret to aim the weapon at a target. The manually operated systems may include electronic controls the operator uses for gross position of the weapon. After such gross positioning, the operator manually moves the weapon to control the direction of fire. The manually operated systems are generally used for suppressive fire applications that fire in a general direction of enemy combatants. Such suppressive fire is used to reduce the ability of the enemy combatants to defend themselves or return fire by forcing such combatants to remain under cover. However, these manually operated turret systems typically require the operator to be physically outside the enclosed area of the vehicle and, thus may be exposed to enemy fire.

Automated weapon turret systems often include a camera system mounted adjacent a weapon. A video signal from the camera system may be displayed on a screen disposed inside the vehicle. The operator watches the video displayed on the screen and uses a user input device, for example, a joystick, a mouse, eye-motion, a gesturing device, or the like coupled to the turret and the weapon to aim the weapon. Further, such automated weapon turret systems are precision fire weapons that include features that automatically identify a target, track a moving target, determine a distance between the weapon and the target, configure the weapon, and the like. These automated weapon turret systems may also include additional complex and expensive sensors, controls, and stabilization capabilities appropriate for precision, sniper-like accuracy but such components exceed the requirements of a weapon turret system used for suppressive fire. Further, because these systems are designed for targeted, sniper applications, the systems may not include cameras that allow an operator to obtain situation awareness or to visually survey the battlefield for enemy locations, movements, targeting, or other activity. Such automated weapon systems are appropriate for use in sniper-like applications that aim at particular enemy combatants rather than suppressive fire.

For at least the foregoing reasons, a need exists for a suppressive fire weapon turret system that may be operated manually and remotely from inside the vehicle but does not include all of the capabilities and complexity, and associated cost, of a fully automated precision weapon system.

SUMMARY

According to one aspect, a dual-mode turret system includes a turret base rotatable by a motor drive of the turret system, a cylindrical sleeve secured to the turret base, a mounting cylinder disposed in the cylindrical sleeve, and a frame secured to the mounting cylinder, wherein the frame is adapted to hold a weapon. The dual-mode turret system also includes a locking apparatus that when engaged prevents the mounting cylinder from rotating independently of the cylindrical sleeve, a controller and an input device coupled to the controller. Rotation of the frame is manually adjustable when the locking apparatus is disengaged, and the rotation of the frame is adjustable by the controller in response to commands received from the input device when the locking apparatus is engaged.

According to another aspect, a method of operating a dual-mode turret system that includes a turret base includes the steps of securing a cylindrical sleeve to the turret base and disposing a mounting cylinder in the cylindrical sleeve. The mounting cylinder has a frame adapted to hold a weapon secured thereto. The method includes the additional steps of receiving by a controller commands from an input device and operating a locking apparatus between an engaged state and a disengaged state. The mounting cylinder and the frame are adapted to be manually rotated when the locking device is disengaged, and the mounting cylinder and the frame are adapted to be automatically rotated by the controller in response to the received commands when the locking mechanism is engaged.

BRIEF DESCRIPTION OF THE DRAWINGS

FIG. 5. is another exploded view of the portion of the weapon holder shown in

FIG. 4;

FIG. 8 is an elevational view of a bearing disposed in one of the arms shown in

FIG. 7;

DETAILED DESCRIPTION

Figure 1:
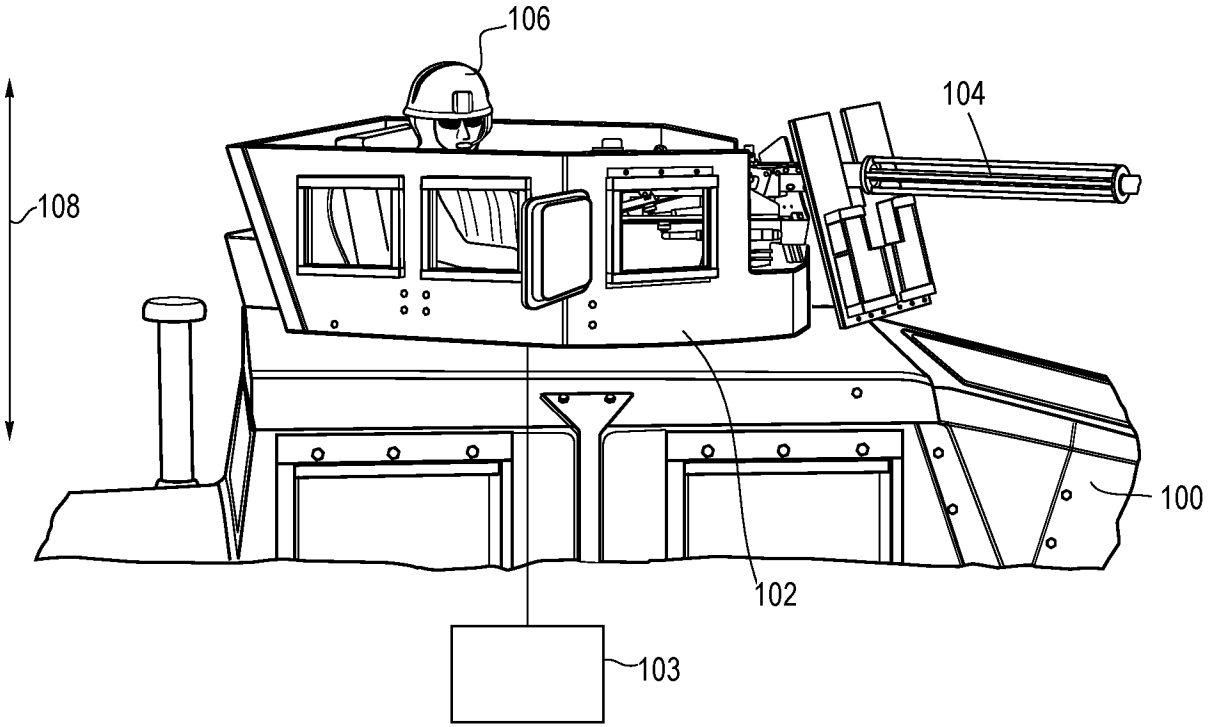
FIG. 1 illustrates an example vehicle and a turret system in operation in the field.
Figure 2:
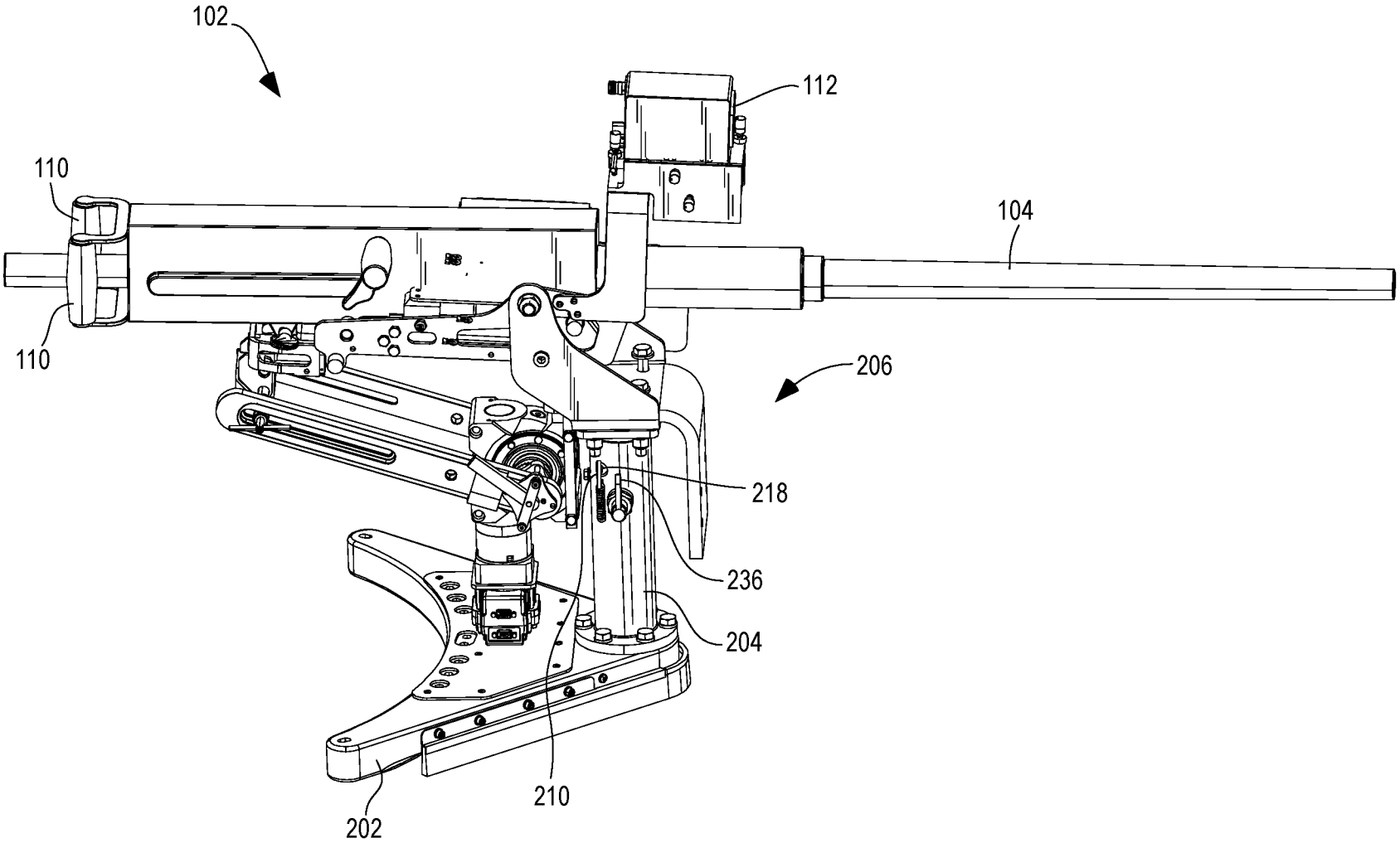
FIG. 2 is an isometric view of a dual-mode turret system for use with the vehicle shown in FIG. 1.
Figure 3:
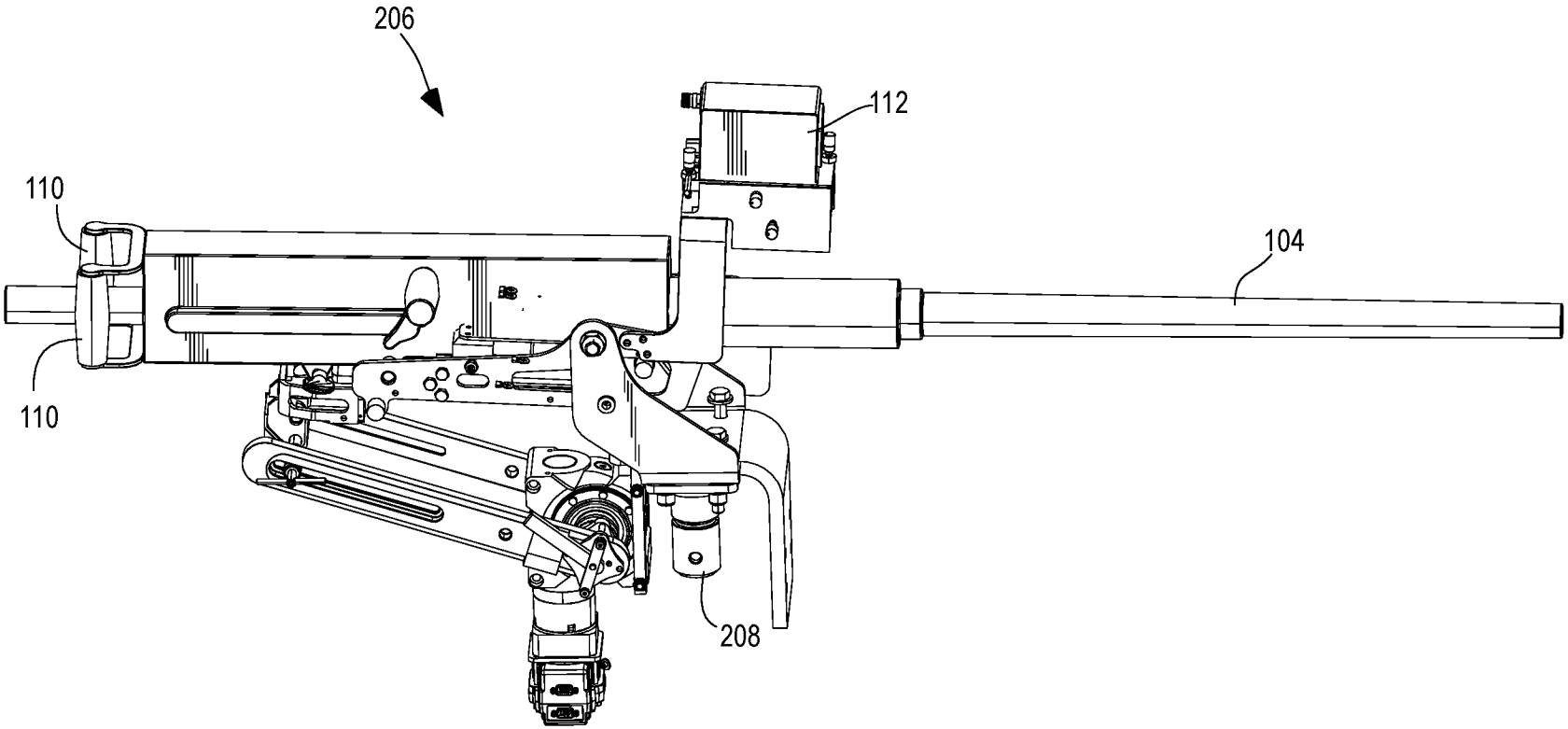
FIG. 3 is an isometric view of a weapon holder of the dual-mode turret system of FIG. 2 and a weapon disposed therein.
Figure 4:
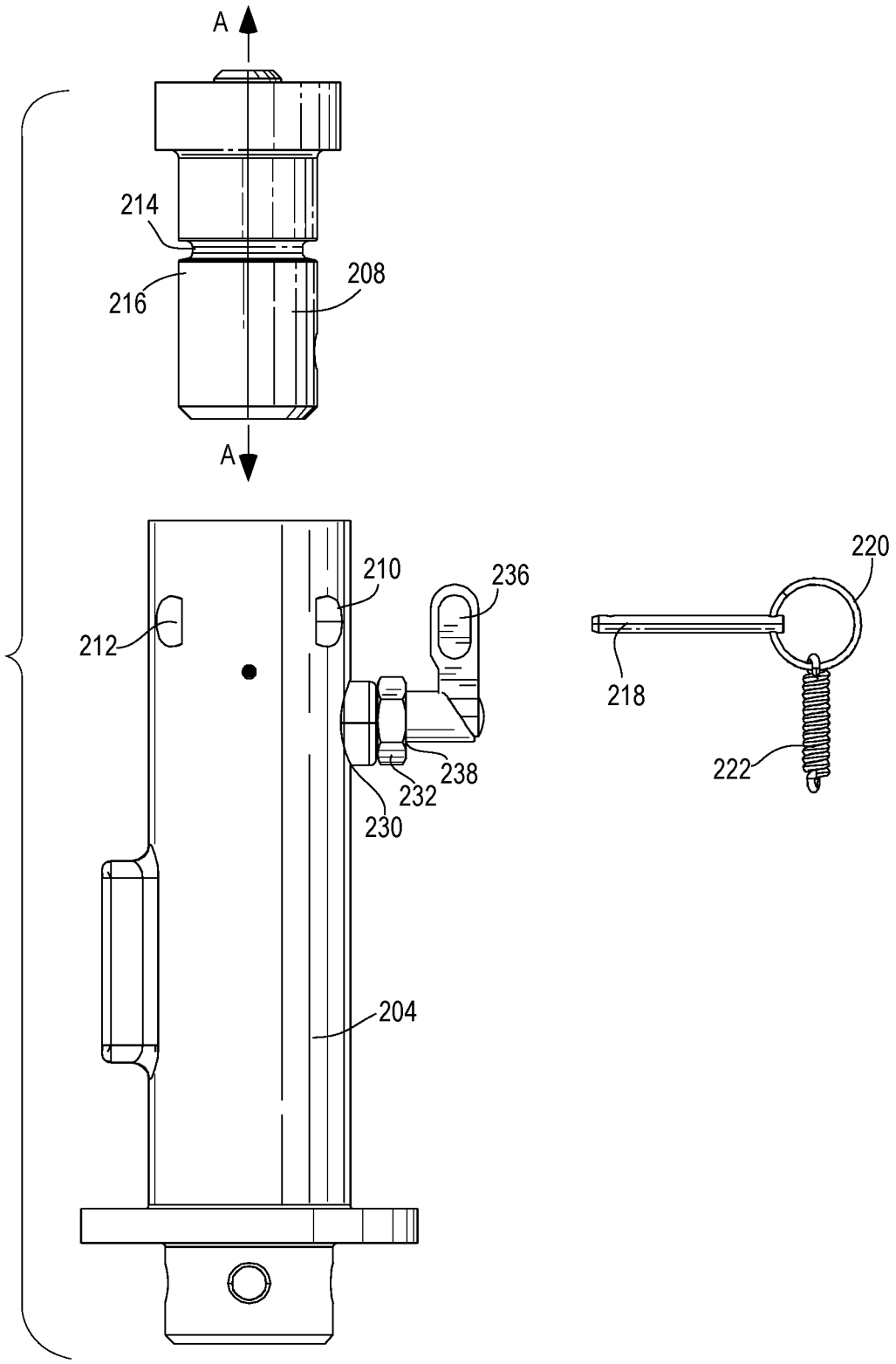
FIG. 4 is an exploded view of a portion of the weapon holder of the dual-mode turret system of FIG. 2.
Figure 5:
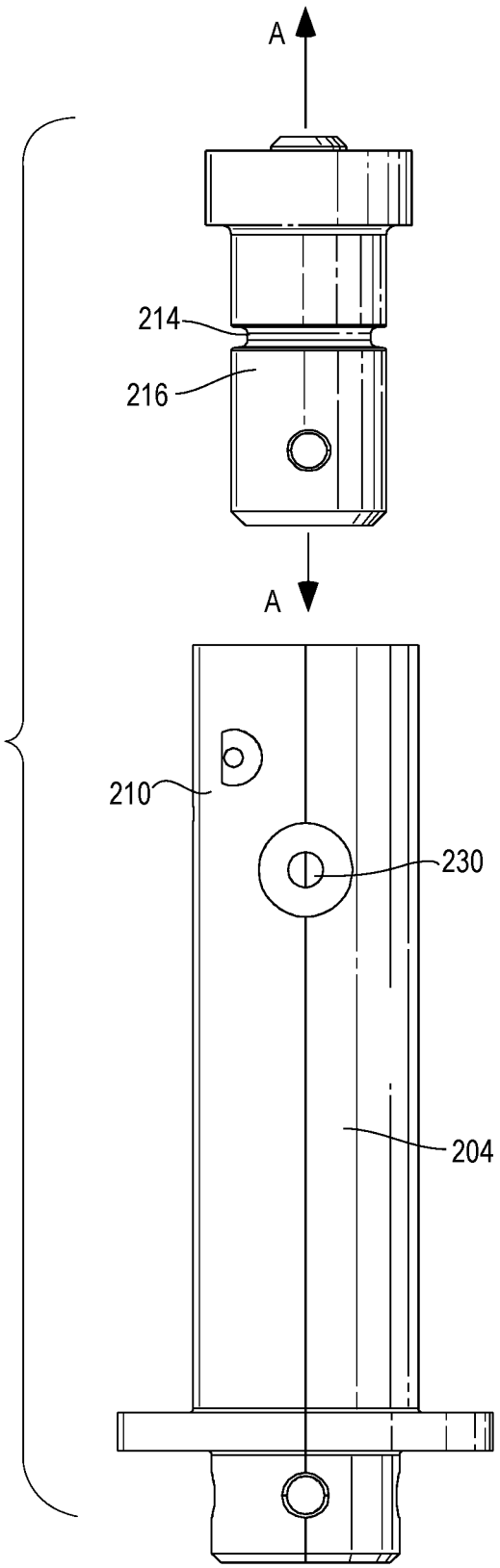

Referring to FIGS. 1 and 2, a vehicle (or a stationary platform) 100 is equipped with a dual-mode turret 102, and a weapon 104 is disposed in the dual-mode turret 102. The dual-mode turret 102 is coupled to a motorized rotation control 103 that an operator 106 can operate to rotate the dual-mode turret 102 about a central axis thereof that is parallel to the line 108. Such motorized rotation control 103 allows the operator 106 to grossly position the dual-mode turret system 102 so that the weapon 104 is directed in a general direction of interest. The weapon 104 may be a 5.56 mm to 0.50-caliber (12.7×99 mm) machine gun. The weapon 104, for example, may be pintle mounted, ring mounted, stationary with a gimble, or rotational on the turret or cupula. The weapon may also be a grenade launcher such as, for example, an MK19 grenade launcher, a laser-based device, and/or a crowd-control system.

In a manual mode, the operator 106 uses handles 110 to manually aim the weapon 104 and change the position of the weapon 104 as necessary to direct fire at an enemy combatant. For example, the dual-mode turret 102 may be rotated 360 degrees using the motorized rotation control 103, and then the operator 106 may manually rotate the weapon 104 within a range of 20 degrees about the axis parallel to the line 108. In addition, the operator 106 manually pivotally adjusts the elevation of the barrel of the weapon 104 by raising or lowering the handles 110.

If the vehicle 100 enters an area in which it is not safe for the operator 106 to be exposed, the operator 106 engages a remote operation mode of the dual-mode turret 102, retreats into the vehicle 100, and operates the dual-mode turret 102 in a remote position from inside the vehicle 100. When operated in the remote operation mode, the operator 106 can view a video signal from a video camera 112 mounted on the dual-mode turret 102, and remotely rotate the dual-mode turret 102, rotate the weapon 104, and adjust the elevation of the barrel of the weapon 104 from inside the vehicle 100.

Referring to FIGS. 2-5 the dual-mode turret 102 includes a base 202 secured to the vehicle 100. As described above, the motorized control rotates the base about an axis of the vehicle that is perpendicular to the line 108. A cylindrical sleeve 204 is fixedly secured to the base 202 so that the cylindrical sleeve 204 follows the rotation of the base 202. A weapon mount 206 is coupled to the cylindrical sleeve 204 such that the weapon 104 disposed in the weapon mount 206 may be manually positioned by using the handles 110 or automatically positioned from inside the vehicle 100 as described below.

In particular, the weapon mount 206 includes a mounting cylinder 208 (FIG. 3) that has a diameter smaller than of the cylindrical sleeve 204 and that is inserted into the cylindrical sleeve 204. The cylindrical sleeve 204 includes a first opening 210 and a second opening 212. The mounting cylinder 208 has a channel 214 formed on an outer surface 216 thereof. The channel 214 spans a circumference of the mounting cylinder 208 such that when mounting cylinder 208 is disposed in the cylindrical sleeve 204, the channel 214 is aligned with the first opening 210 and the second opening 212. To prevent accidental separation of the mounting cylinder 208 from the cylindrical sleeve 204, a pin 218 is passed through the first opening 210, along the channel 214, and through the second opening 212. In some embodiments, the pin 218 includes a pull ring 220 and a tether or spring 222 to facilitate grasping, inserting, and/or removing the pin 218. The tether or spring 222 may be affixed to the cylindrical sleeve 204 to prevent misplacing the pin 218.

The cylindrical sleeve 204 includes a third opening 230 and a threaded nut 232 is secured to the third opening 230. The mounting cylinder 208 includes an opening 234 disposed such that when the mounting cylinder 208 is disposed in the cylindrical sleeve 204, the opening 234 in the mounting cylinder 208 is aligned with the third opening 230 of the cylindrical sleeve 204. A latch 236 having a threaded shaft 238 is rotatably secured to the threaded nut 232. Rotating the latch 236 in a first direction (e.g., clockwise) drives the threaded shaft 238 through the threaded nut 232 and into the opening 234 in the mounting cylinder 208 and prevents rotational movement of the mounting cylinder 208 about a central axis A-A thereof relative to the cylindrical sleeve 204. Thus, the movement of the mounting cylinder 208 and the cylindrical sleeve 204 are locked to one another and both are under control of the motorized rotation control 103 (FIG. 1).

Rotating the latch 236 in a second direction opposite the first direction (e.g., counter-clockwise) until the threaded shaft 238 is released from the opening 234 in the mounting cylinder 208 allows the mounting cylinder 208 to rotate independently about the axis A-A within the cylindrical sleeve 204. It should be apparent that although the pin 218 prevents separation of the mounting cylinder 208 from the cylindrical sleeve 204, the pin 218 does not significantly inhibit rotation of the mounting cylinder 208 within the cylindrical sleeve 204 because the pin 218 rides in the channel 214 during such rotation.

Figure 6:
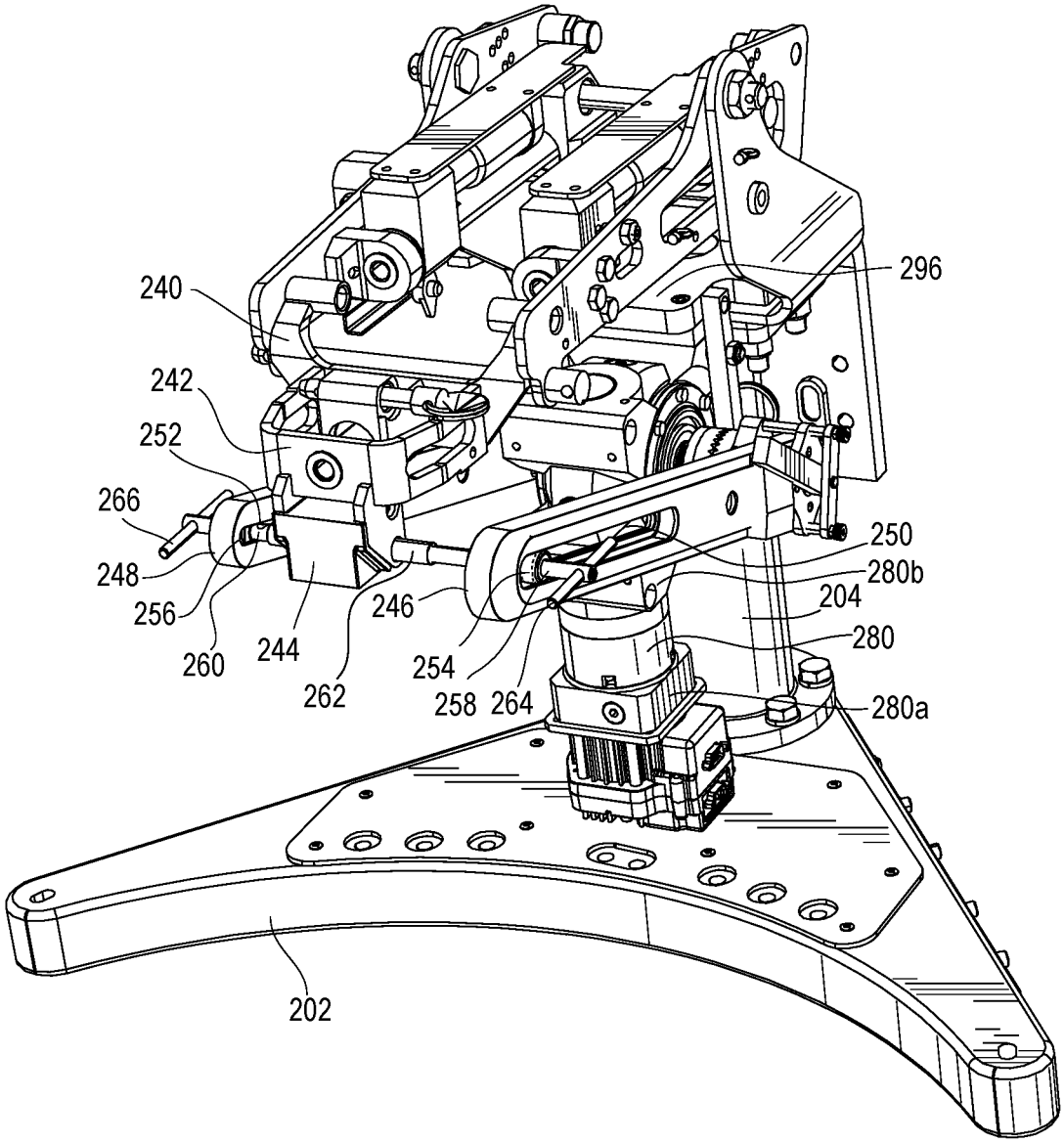
FIG. 6 is another isometric view of the weapon holder of the dual-mode turret system of FIG. 2.

Referring to FIG. 6, the weapon holder 206 includes a frame 240 into which the weapon 104 may be disposed and includes a rear portion 242 having a block 244. The weapon holder 206 further includes a first arm 246 and a second arm 248 disposed on opposite sides of the block 244.

Figure 7:
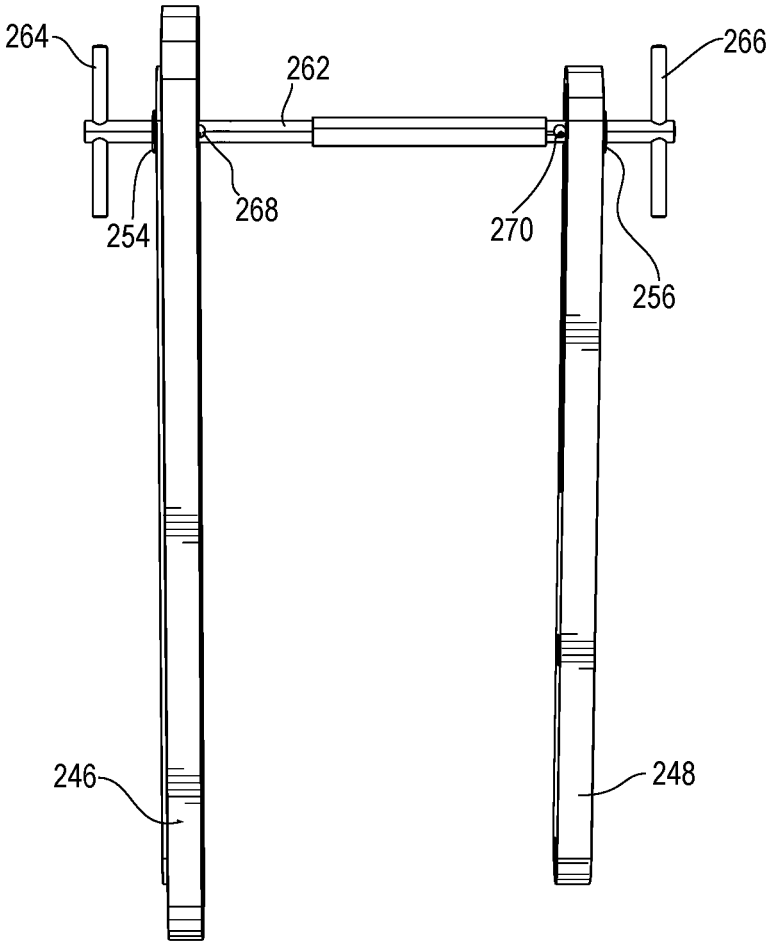
FIG. 7 is an elevational view of arms and a rod that comprise the weapon holder of the dual-mode turret system of FIG. 2
Figure 8:
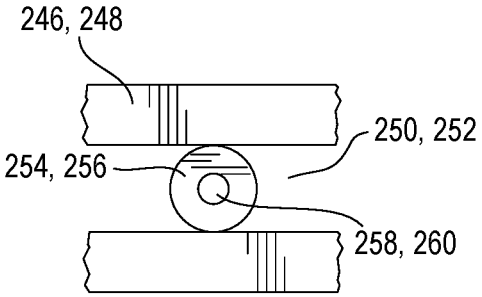

Referring also to FIGS. 7 and 8, each of the first and second arms 246 and 248 include a substantially linear first slot 250 and second slot 252, respectively, cut along the length thereof. A first bearing 254 and a second bearing 256 are disposed in the first slot 250 and the second slot 252, respectively, and adapted to travel along the length of such slot. The first bearing 254 and the second bearing 256 includes central openings 258 and 260, respectively.

A rod 262 is passed through the central opening 258 of the first bearing 254, through the rear block 244 of the frame 240 of the weapon holder 104, and through the central opening 260 of the second bearing 256. In some embodiments, the rod 262 terminates with tethered slider bearing 264 and 266 that prevent the rod 262 from accidently sliding out of the central openings 258 and 260, respectively. In this manner, the frame 240, and thus the weapon 104 disposed therein, is coupled to the arms 246 and 248 such that when the elevation (or azimuth) of the frame 240, and thus the weapon 104 disposed in the frame 240, is manually or remotely raised or lowered, the frame 240 and the arms 246 and 248 move in accordance with such manual and or remote movement.

In some embodiments, the rod 262 includes first and second openings 268 and 270 therethrough. The first opening 268 and the second opening 270 are disposed between and proximate the first arm 246 and the second arm 248. A clevis pin or other type of pin (not shown) may be passed through one or both of the first opening 268 and the second opening 270 to hold the rod 262 in place. In some embodiments, the rod 262 may be removable, for example, removing any pins disposed in the first opening 268 and the second opening 270, and if necessary, one or both of the tethered slider bearings 264 and 266, and sliding the bar away from the first arm 246 and the second arm 239. Such removal of the rod 262 may be undertaken in the field if it is necessary to decouple the weapon 104 disposed in the weapon frame 240 from the first arm 246 and the second arm 248.

Figure 9:
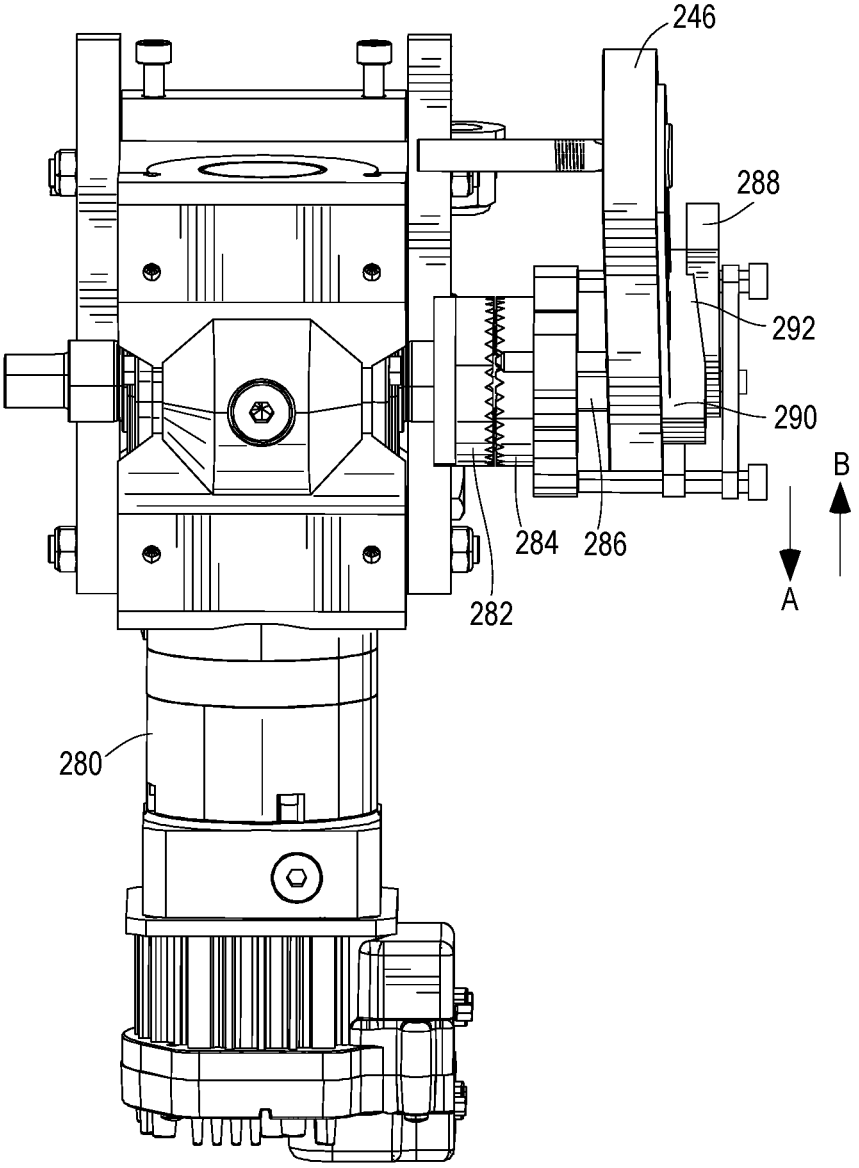
FIG. 9 is an elevational view of a drive motor coupled to one of the arms of the weapon holder shown in FIG. 4.
Figure 10:
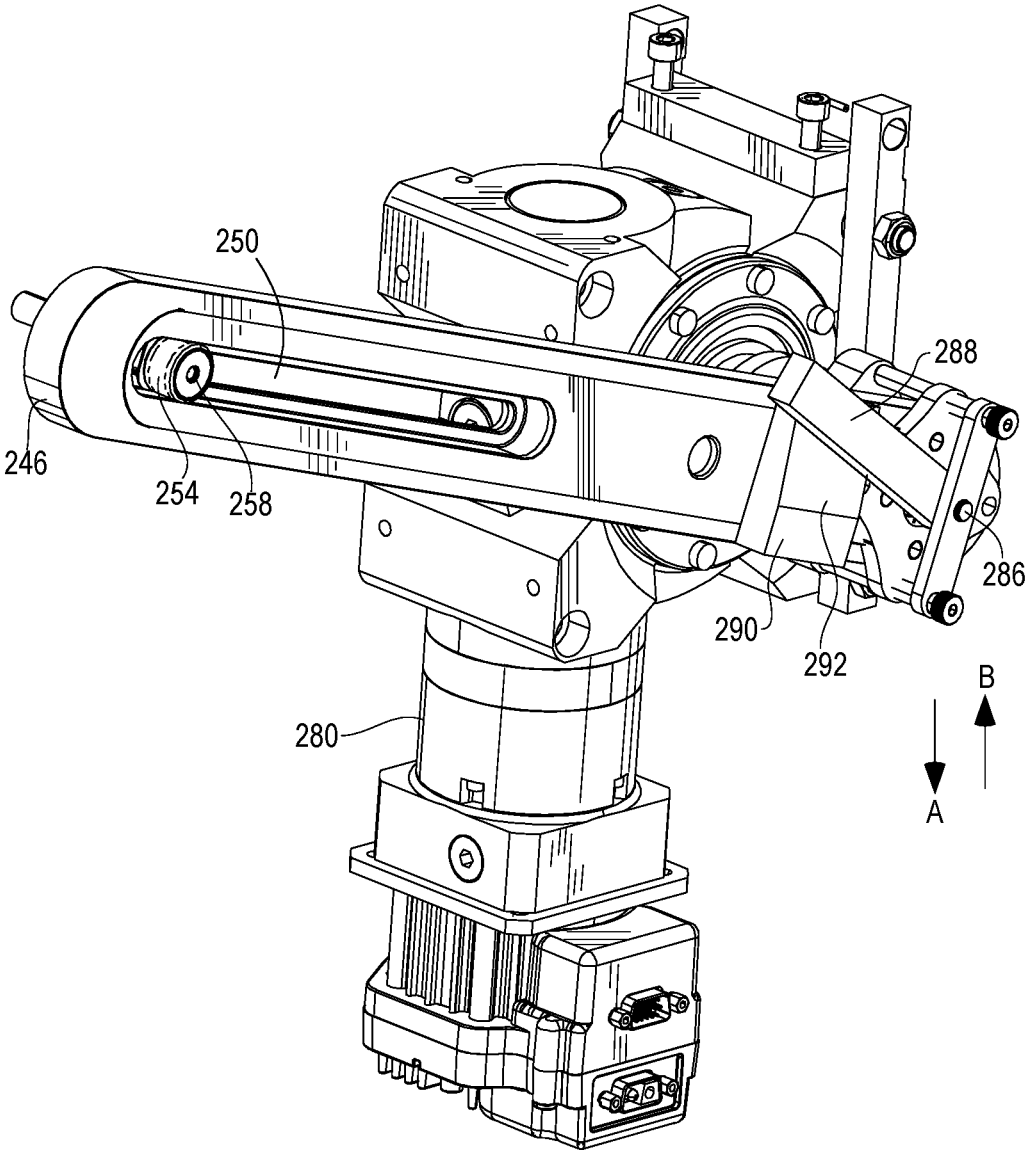
FIG. 10 is an isometric view of the drive motor coupled to one of the arms of the weapon holder shown in FIG. 4.

Referring to FIGS. 6, 9, and 10, the dual-mode turret 102 includes a drive motor 280, a first serrated gear 282, and a second serrated gear 284. The first serrated gear 282 is coupled to a drive shaft (not shown) of the drive motor 280. The second serrated gear 284 is coupled to an axle 286, and the axle 286 is fixedly secured to the first arm 246 and a lever 288. The second serrated gear 284 and the lever 288 are disposed on opposite sides of the first arm 246. A spacer block 290 is secured to the first arm 246 and disposed between the first arm 246 and the lever 288. The axle 286 is journaled through an opening in the spacer block 290 and secured to the lever 288.

The spacer block 290 includes outward face 292 that is ramped such the sliding the lever 288 along the face 292 in a direction A urges the second serrated gear 284 and the first arm 246 away from the first serrated gear 282. Similarly, sliding the lever 288 along the face 292 in a direction B, opposite the direct A, urges the second serrated gear 284 toward the first serrated gear 282. Further, moving the lever 288 in the direction B until the lever no longer contacts the face 292 of the spacer block 290 causes the lever 288, the first arm 246, and the second serrated gear 284 to move towards the first serrated gear 282 until the teeth of the first and second serrated gears 282 and 284 are engaged.

When the first serrated gear 282 and the second serrated gear 284 are engaged as described above, rotation of the first serrated gear 282 by the drive shaft of the drive motor 280 causes rotation of the second serrated gear 284, and in turn causes rotation of the first arm 246 about a central axis of the first serrated gear 282. Because the first arm 246 and the second arm 248 are mechanically coupled by the rod 262, rotation of the first atm 246 also causes rotation of the second arm 248, and the first bearing 254 and the second bearing 256 travel along the length of the first and second slots 250 and 252, respectively. Such rotation of the first arm 246 and the second arm 248 cause the frame 240 to rotate about the central axis of the rod 262, and thus cause the elevation of the weapon 104 disposed in such frame 240 to raise or lower in accordance with such rotation. In some embodiments, the drive motor 280 includes a motor 280*a* and a gearbox 280*b* disposed between the motor 280*a* and the first arm 246. When the output shaft (not shown) of the motor 280*a* is rotated, the gearbox 280*b* causes rotation of the arm first arm 246 (e.g., via the first serrated gear 282 and the second serrated gear 284 as described above).

Referring to FIGS. 1-10, to operate the dual-mode turret 102 in a manual mode, the operator positions the latch 236 so that the mounting cylinder 208 (FIG. 3) is not engaged with the cylindrical sleeve 204 and operates the lever 288 so that the first serrated gear 282 is not engaged with the second serrated gear 284. In this mode, the frame 240 and the weapon 104 disposed therein may be moved using the handles 110.

To operate the dual-mode turret 102 in a remote mode, the operator 106 positions the latch 236 so that the mounting cylinder 208 is mechanically engaged with the cylindrical sleeve 204 and the rotation of the mounting cylinder 208 is locked to the rotation of the cylindrical sleeve 204. In addition, the operator positions the lever 288 to engage the first serrated gear 282 with the second serrated gear 284 so that rotation of the first serrated gear 282 by the drive motor 280 causes rotation of the second serrated gear 284.

In some embodiments, referring once again to FIG. 6, a plate 296 is secured to the mounting cylinder 208 (FIG. 3) and the frame 240 is secured to the plate 296. Thus, rotation of the mounting cylinder 208 causes the frame 296 and the weapon 104 disposed therein to rotate accordingly. In some embodiments, the drive motor 280 is also secured to the plate 296 so that the drive motor 280 rotates in synchrony with the mounting cylinder 208. Further, in an exemplary embodiment, the drive motor 280 is disposed between the frame 296 and the base 202 of the turret.

In addition, the operator 106, if necessary, connects an electronic cable from a trigger actuator (302, FIG. 11) to the weapon 104 so that the weapon 104 may be fired remotely as described below. Alternately, the operator 106 may actuate a switch to activate a circuit that allows remote control of the trigger mechanism of the weapon 104.

Thereafter, the operator 106 may descend into the vehicle 100 (FIG. 1) and remotely control the movement of the weapon holder 206, and therefore the weapon 104.

Figure 11:
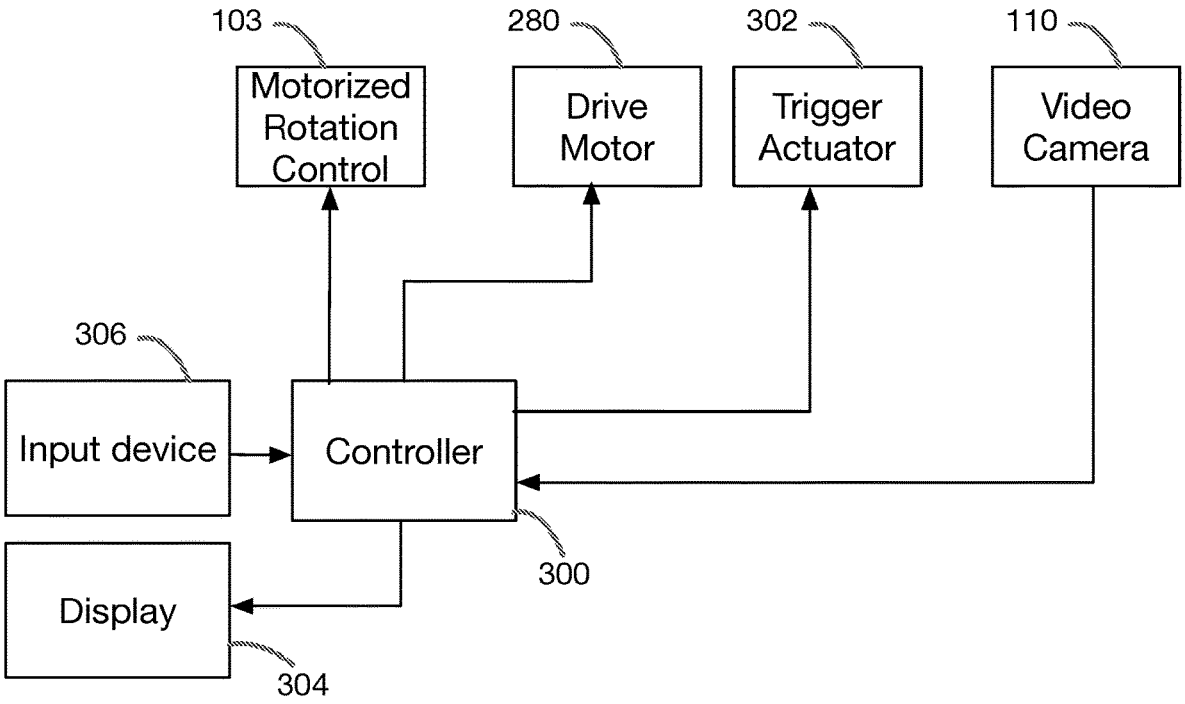
FIG. 11 is a block diagram of a control system used to control the dual-mode turret system of FIG. 2.

Referring to FIG. 11, a controller 300 is electrically coupled to the video camera 112, the motorized rotation control 103, the drive motor 280, and the trigger actuator 302. In some embodiments, the trigger actuator 302 is a remote-firing solenoid coupled to a trigger of a weapon 102, and electrically connected via a cable to the controller 300. The controller 300 receives the video signal from the video camera 112, processes such signal if necessary, and displays a video on a display 304 in the vehicle 100. The operator 106 in the vehicle 100 can view such video on the display 304, and use an input device 306 to issue movement directives to the controller 300. The input device 306 may be a joystick, a mouse, touchpad and the like.

The controller 300 receives movement directives and translates such movement directives to actuate the motorized rotation control 103 and the drive motor 280 to cause the weapon holder 206 to move in accordance with the movement directives.

It should be apparent that a slip ring may be used between the turret base 202 and the vehicle 100 to manage the cabling between the controller 300 and the video camera 112, the motorized rotation control 103, the drive motor 280 and the trigger actuator 302, without interfering with the rotation of the turret base 202 and the vehicle 100.

To operate the dual-mode turret 102 manually once again, the operator 106 positions the latch 236 to disengage the mounting cylinder 208 and the cylindrical sleeve 204, positions the lever 288 to disengage the first serrated gear 280 from the second serrated gear 282, and disengages the trigger cable from the weapon 104.

In one embodiment, the video display 304 is a tablet computer such as one manufactured by the Samsung Corporation of Seoul, South Korea. It should be apparent that comparable components from other manufacturers may be used in the embodiment described above. In some embodiments, the drive motor 280 comprises an inline drive consisting of a motor 280*a* and one or more gearbox(es) 280*b*. In some embodiments, the motor 280*a* is disposed in a 90-degree orientation protruding towards the rear of the weapon holder 206 (i.e., toward the operator 106). Any type of drive motor 280 apparent to one who has skill may be used including a clutched motor, a back-drivable motor, and the like.

In some embodiments, a crosshair (or other icon) may be displayed on the display 304 to indicate a region where the weapon 104 is aimed. The operator 106 may use the input device 306 to move such crosshair and thereby select a target or target region displayed on the display 304. Thereafter, a stabilization or targeting system may be engaged to keep the crosshair, and therefore the weapon 104, aligned with the target region while the vehicle 100 is moving, for example, over rough terrain. The stabilization system may include a servo-controller that maintains the position of the weapon 104 by compensating for movement of the weapon 104 caused by movement of the vehicle 100. Such stabilization system may be a gyroscopic stabilization system that tracks movement of the vehicle 100 and compensates for such movement to keep the weapon 104 pointed in a constant direction. Alternately, such stabilization system may optically track the target region and maintain the direction of the weapon 104 relative to such target region. Use of such a stabilization system enables the target image to remain within the field of view displayed on the display 304. The operator can continue to make adjustments to the aim of the weapon 104 (as indicated by the crosshair) as needed over the target or target region, or over a different target or target region. The video camera 112 may be a targeting camera with a wide field-of-view with an electronic crosshair.

In the embodiments described above, the controller 300 (FIG. 8) includes software and hardware components (not shown) to generate control signals in response to receipt of the input signals from components coupled thereto. The controller 300 may transmit the control signals to the motorized control 103 to affect the rotation of the turret base 202. For example, the controller may be programmed with logic that interprets input signals from various input devices 306 and that generates control signals that control the rotation of the motorized rotation control 103, the operation of the drive motor 280, and the trigger actuator 302. The logic may be executed by a processing device (not shown), such as a microprocessor capable of executing instructions or code. The processing device also includes a memory (not shown), which may be any form of data storage mechanism accessible by the processing device or any combination of such forms, such as, a magnetic media, an optical disk, a volatile random-access memory (RAM), a flash memory, or a non-volatile electrically erasable programmable read-only memory (EEPROM). Moreover, the controller 300 may include various input/output ports and circuitry (not shown) to monitor readings from various sensors coupled to the controller. Alternative arrangements, such as employment of programmable logic controllers (PLCs) or other control devices may selectively be employed for providing instructions to control the dual-mode turrets 102 and 400.

INDUSTRIAL APPLICABILITY

The weapon turret system described in the foregoing provides automation for use in suppressive fire applications without the expense of typical automated, precision targeting system. The weapon disposed in the dual-mode turret system may be positioned and operated manually or remotely from within in the vehicle in which the turret system is disposed. The dual-mode turret system is not mission specific, is flexible and universal, and provides good situational awareness to the operator. Further, because the dual-mode turret system is not designed with mission specific precision electronics that are not necessary for suppressive fire applications, the dual-mode turret may be significantly less expensive than fully automated systems. Further, as disclosed herein, existing manual mode turret systems may be adapted with a parts kit into the dual-mode turret system. Numerous modifications to the present embodiments will be apparent to those skilled in the art in view of the foregoing description. Accordingly, this description is to be construed as illustrative only and is presented for the purpose of enabling those skilled in the art to make and use the embodiments disclosed herein and to teach the best mode of carrying out same.

What is claimed is:

1. A dual-mode turret system, comprising:

a turret base operable by a motor drive of the turret system;

a cylindrical sleeve secured to the turret base;

a mounting cylinder disposed in the cylindrical sleeve;

a frame secured to the mounting cylinder, wherein the frame is adapted to hold a weapon;

a locking apparatus movable between an engaged position and a disengaged position;

an arm coupled to the frame and having a slot therein;

a movable bearing disposed in the slot and coupled to the frame;

a drive motor;

a controller; and an input device coupled to the controller;

wherein the arm is mechanically coupled to the drive motor when the locking apparatus is in the engaged position and the controller operates the drive motor to cause the arm to rotate to adjust the elevation of the frame in response to commands received from the input device, and the arm is mechanically decoupled from the drive motor when the locking apparatus is in the disengaged position and the elevation of the frame is manually adjustable.

2. The dual-mode turret system of claim 1, wherein the locking apparatus comprises a first locking apparatus and the dual-mode turret system further includes a second locking apparatus, wherein the second locking apparatus mechanically couples the mounting cylinder and the cylindrical sleeve when engaged and thereby prevents the mounting cylinder from rotating independently of the cylindrical sleeve, the second locking apparatus includes a locking shaft, and insertion of the locking shaft into an opening in the mounting cylinder engages the locking apparatus.

3. The dual-mode turret system of claim 2, wherein the second locking apparatus includes a latch coupled to the locking shaft, and rotation of the latch causes the locking shaft to be inserted into the opening.

4. The dual-mode turret system of claim 2, wherein the controller causes rotation of the frame in accordance with the commands received from the input device when the second locking apparatus is engaged and rotation of the frame is manually adjustable when the second locking apparatus is disengaged.

5. The dual-mode turret system of claim 1, further comprising a first serrated gear mechanically coupled to the drive motor and a second serrated gear mechanically coupled to the arm, wherein engaging the locking apparatus causes engagement of the first serrated gear and the second serrated gear.

6. The dual-mode turret system of claim 5, wherein the controller operates the drive motor to cause rotation of the second serrated gear only when the locking apparatus is engaged.

7. The dual-mode turret system of claim 5, wherein the locking apparatus includes a lever and movement of the lever urges the second serrated gear to move toward or away from the first serrated gear.

8. The dual-mode turret system of claim 1, wherein the drive motor is disposed between the frame and the turret base.

9. A dual-mode turret system, comprising:

a controller;

an input device coupled to the controller;

a turret base operable by a motor drive of the turret system;

a cylindrical sleeve secured to the turret base;

a mounting cylinder disposed in the cylindrical sleeve;

a frame secured to the mounting cylinder, wherein the frame is adapted to hold a weapon;

a first locking apparatus that when engaged mechanically couples the mounting cylinder and the cylindrical sleeve and prevents the mounting cylinder from rotating independently of the cylindrical sleeve;

an arm coupled to the frame;

a second locking apparatus that when engaged mechanically couples the arm to a drive motor and the controller operates the drive motor in response to commands received from the input device to cause rotation of the arm to adjust the elevation of the frame, and when disengaged mechanically decouples the arm from the drive motor and the arm may be rotated manually to adjust elevation of the frame;

wherein rotation of the frame is manually adjustable when the first locking apparatus is disengaged, and the rotation of the frame is adjusted by the controller in response to commands received from the input device when the first locking apparatus is engaged; and wherein the arm includes a slot, a bearing is disposed in the slot, the bearing is coupled to the frame, and the bearing moves in the slot when the elevation of the frame is adjusted by the controller.

10. The dual-mode turret system of claim 9, further comprising a gearbox disposed between the drive motor and the arm, wherein rotation of an output shaft of the drive motor causes the gearbox to rotate the arm.

11. A method of operating a dual-mode turret system, wherein the dual-mode turret system includes a turret base comprising the steps of:

securing a cylindrical sleeve to the turret base;

disposing a mounting cylinder in the cylindrical sleeve, wherein the mounting cylinder has a frame adapted to hold a weapon secured thereto;

coupling an arm having a slot therein to the frame;

disposing a moveable bearing in the slot and coupling the movable bearing to the frame;

receiving by a controller commands from an input device;

moving a locking apparatus from a disengaged state to an engaged state to mechanically couple the arm to a motor; and operating the controller when the locking apparatus is in the engaged state to operate the motor to cause the arm to rotate and thereby adjust elevation of the frame in response to the received commands.

12. The method of claim 11, wherein the locking apparatus comprises a first locking apparatus and the method includes the further step of operating a second locking apparatus from a disengaged state to an engaged state to mechanically couple the mounting cylinder and the cylindrical sleeve such that when the second locking apparatus is in the engaged state the controller rotates the mounting cylinder and the cylindrical sleeve in response to commands received from the input device, and wherein operating the second locking apparatus from the disengaged to the engaged state includes inserting a locking shaft into an opening in the mounting cylinder.

13. The method of claim 12, wherein inserting the locking shaft includes rotating a latch.

14. The method of claim 12, wherein the rotation of the frame is manually adjustable when the second locking apparatus is in the disengaged state.

15. The method of claim 11, wherein operating the locking apparatus from a disengaged state to an engaged state includes causing engagement of a first serrated gear coupled to the drive motor and a second serrated gear coupled to the arm.

16. The method of claim 15, wherein the step of operating the controller to operate the drive motor includes causing rotation of the second serrated gear by the drive motor.

17. The method of claim 16, further including the step of disposing the drive motor between the frame and the turret base.

18. The method of claim 15, wherein the locking apparatus includes a lever, further including the step of operating the lever to urge the second serrated gear to move toward or away from the first serrated gear.

19. The method of claim 11, wherein rotating the arm comprises operating a motor and including the further step of using a gearbox to couple the motor to the arm.

* * * * *